United States Patent [19]

Harper, Jr.

[11] Patent Number: 4,743,266

[45] Date of Patent: May 10, 1988

[54] PROCESS FOR PRODUCING SMOOTH-DRY CELLULOSIC FABRIC WITH DURABLE SOFTNESS AND DYEABILITY PROPERTIES

[75] Inventor: Robert J. Harper, Jr., Metairie, La.

[73] Assignee: The United States of America as represented by the Secretary of Agriculture, Washington, D.C.

[21] Appl. No.: 905,208

[22] Filed: Sep. 9, 1986

[51] Int. Cl.[4] ..... D06P 5/00; D06M 13/34

[52] U.S. Cl. ..... 8/181; 8/188; 8/918; 8/480

[58] Field of Search ..... 8/485, 188, 189, 480, 8/481, 918, 181

[56] References Cited

U.S. PATENT DOCUMENTS

| | | | |
|---|---|---|---|
| 3,788,804 | 1/1974 | Harper et al. | 8/498 |
| 3,807,946 | 4/1974 | Harper et al. | 8/185 |
| 3,853,459 | 12/1974 | Harper, Jr. et al. | 8/606 |
| 3,925,462 | 12/1975 | Graff | 8/192 |
| 3,960,477 | 6/1976 | Harper, Jr. et al. | 8/481 |
| 4,104,443 | 8/1978 | Latta et al. | 428/474 |
| 4,629,470 | 12/1986 | Harper, Jr. | 8/606 |

*Primary Examiner*—A. Lionel Clingman

*Assistant Examiner*—John F. McNally

*Attorney, Agent, or Firm*—M. Howard Silverstein; David G. McConnell; John D. Fado

[57] ABSTRACT

Process for producing smooth dry-cellulose containing fabrics with durable softness and dyeable properties are disclosed. Cellulose containing fabric is treated with a solution of crosslinking agent, acid catalyst and a long-chain alkyl bishydroxyethyl quaternary amine salt additive. The resultant fabric is smooth-dry durably softened and can be dyed. Printdyeing is accomplished by selective application of the alkyl quaternary to a fabric padded with a crosslinking agent. This treatment is then followed by curing and dyeing. Differential dyeing is accomplished by first treating separate yarns with different solutions containing crosslinking agent with and without the alkyl quaternary, drying, knitting, curing and then dyeing the knitted fabric. Multicolored cross-dyed cellulosic fabrics which are partly crosslinked are produced by crosslinking preselected areas of fabric with a grafted cationic group and leaving other areas untreated; immersing the fabric in an acidic anionic dyebath to dye the cationic areas and then immersing in a different colored alkaline, reactive dyestuff dyebath to dye the untreated areas.

28 Claims, No Drawings

PROCESS FOR PRODUCING SMOOTH-DRY CELLULOSIC FABRIC WITH DURABLE SOFTNESS AND DYEABILITY PROPERTIES

BACKGROUND OF THE INVENTION (1) Field of the Invention

This invention relates to processes for enhancing the dyeability and softness of crosslinked cellulosic fabrics.

(2) Description of the Prior Art

The application of crosslinking agents to cellulosic fabrics to improve smooth drying properties has the detrimental effect of reducing strength properties and reduces their affinity for dyes. Examples of some agents that are utilized to crosslink cellulose are dimethylol dihydroxyethylene (DMDHEU) and trimethylol acetylenediureine (GUR).

Modern textile practice requires that cellulosic fabric be dyed before finishing for smooth dry performance. These fabrics when crosslinked with readily available agents, are dye resistant. There are a few known methods which permit dyeing subsequent to crosslinking. Examples of such processes would include U.S. Pat. No. 3,788,804 (Harper et al.) which teaches the use of crosslinking agents and hydroxycarboxylic acids to form crosslinked fabrics with acidic grafts and dyeing the fabric with basic dyes. Also, U.S. Pat. No. 3,807,946 (Harper et al.) teaches the use of crosslinking agents and a reactive additive such as triethanolamine to form a crosslinked fabric with a grafted amine and dyeing with an acid dye.

U.S. Pat. No. 3,853,459 (Harper et al.) Utilizes a treatment of cross-linking agent and polymer to form a durable-press fabric with a polymeric treatment and dyeing with a disperse dyestuff. These patents teach in common dyeing modified cellulosic fabrics with non-cellulosic dyestuffs. Consequently, the performance of these dyes on a cellulosic substrate is not as good as cellulose dyed with normal dyestuffs such as direct or reactive dyes which are usually used on cellulosic fabrics.

Also many millions of pounds of softeners and builders are utilized in laundry fabrics to give such laundered fabrics an acceptable and soft hand. Such materials are added during laundering, but permanent binding of these agents would confer durable properties to cellulosic fabric.

SUMMARY OF THE INVENTION

This process consists of a method for permanently attaching methyl(polyoxyethylene)alkylammonium salts (alkyl quaternary) to cellulose containing fabric and the subsequent dyeing of such fabrics via the grafted quaternary group. At the same time as the fabric is crosslinked, the alkyl quaternary is grafted to cellulose. Thus, the process consists of padding a cellulosic containing fabric with an aqueous finishing solution comprising sufficient concentrations of N-methylol crosslinking agent, acid catalyst and alkyl bishydroxyethyl quaternary to impart smooth-dry properties, durable softness and dyeability. The fabric is then dried and cured for sufficient time to interact the final components. The resultant fabric is smooth-drying with a long chain alkyl group for enhanced smoothness and a soft hand. In addition, the fabric can now be dyed with anionic dyes under acidic conditions and as such is a dyeable crosslinked fabric.

DESCRIPTION OF THE PREFERRED EMBODIMENTS

In the preferred embodiments, the general structure of the grafting additive is shown in the following chemical structure:

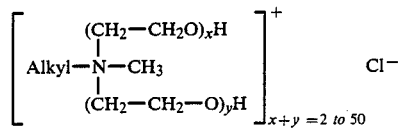

The basic structure, wherein the quaternary contains a long chain alkyl group and bis hydroxyethyl groups, and a quaternary nitrogen can be varied in the following manner: The longchain alkyl group can be mixed alkyl in which the dominant groups can be dodecyl, tetradecyl, hexadecyl, octadecyl or octadecenyl or octadecadienyl.

In general, the alkyl groups contain from 8–18 carbon atoms. However, other alkyl groups, with this structure containing between 1 and 30 carbon atoms, should be effective. Likewise, the combined total of the ethylene oxide groups (x or y) can vary from 2 to 50. Again, a greater total, such as 2 to 100, would not detract from the efficacy of these reagents. Finally, it should be noted that the other important structural feature of these additives is the quaternary nitrogen group which will be utilized because it carries a positive charge in the subsequent post dyeing of the finished fabric.

Although specific reactive additives as described in Tables I and II were used other additives as described in the basic structure supra can also be used.

TABLE I

| Name of Ethoxylated Quaternary | Dominant Alkyl Groups | Number of Ethyleneoxide Units |
|---|---|---|
| C-12 | Coco | 2 |
| C-25 | Coco | 15 |
| 18-12 | Octadecyl | 2 |
| 18-25 | Octadecyl | 15 |
| 0-2 | Oleyl | 2 |
| 0-25 | Oleyl | 15 |

TABLE II

| Carbon Distribution | Dominant Alkyl Groups | | |
|---|---|---|---|
| | Coco | octadecyl | oleyl |
| Octyl, $C_8$ | 6 | — | — |
| Decyl, $C_{10}$ | 7 | — | — |
| Dodecyl, $C_{12}$ | 51 | — | 0.5 |
| Tetradecyl, $C_{14}$ | 19 | — | 1.5 |
| Pentadecyl, $C_{15}$ | — | — | trace |
| Hexadecyl, $C_{16}$ | 9 | 9 | 4 |
| Heptadecyl, $C_{17}$ | — | 2 | 0.5 |
| Octadecyl, $C_{18}$ | 2 | 87 | 14 |
| Tetradecenyl, $C_{14'}$ | — | — | 0.5 |
| Hexadecenyl, $C_{16'}$ | — | — | 4 |
| Octadecenyl, $C_{18'}$ and/or Octadecadienyl, $C_{18'}$ | 6 | 2 | 75 |

Generally, in the preferred embodiments of this invention, in order to produce smooth-dry cellulosic fabric which is dyeable, a finish must contain a crosslinking agent, an acid catalyst and a reactive additive to impart a cationic character to the crosslinked fabric.

The crosslinking agent performs a twofold function. First, it reacts with cellulose to produce a fabric with a required resilience. Second, it reacts chemically with ethoxylated quaternary to graft this additive into the cellulose substrate, thus binding a substantial portion of the quaternary to cellulose via the agent.

From a chemical point of view, the unique characteristic of this finish is the interaction between the cellulose fiber, crosslinking agent, and the additive to produce a chemical matrix in which all three components are chemically bound together. In this approach, it is advantageous to use an agent with several reactive sites to improve the efficiency of the grafting reaction. These quaternary grafts impart a cationic character to crosslinked fabric making cellulosic sites accessible for subsequent dyeing. A particularly effective agent for this purpose is dimethylol dihydroxyethyleneurea (DMDHEU) because of its multiple reactive sites, widespread use in conventional finishing by the industry, and cost considerations. Other agents with multiple reactive sites which can be used are trimethylol acetylenediureine (GUR), tetramethylol acetylenediureine (4ACD), methylol melamine (TMM), and methylol dicarbamate derived from pentaerythritol (XCP). In addition, difunctional agents such as dimethylol propylcarbamate (DMPC) can be employed provided the necessary ratio of additive to crosslinking agent is utilized.

Examples of representative structures of effective crosslinking agents are:

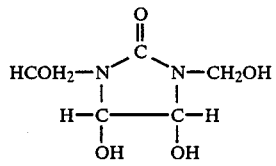

DMDHEU

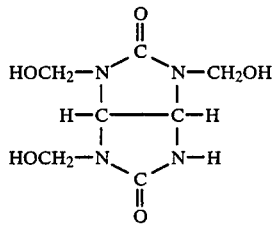

GUR

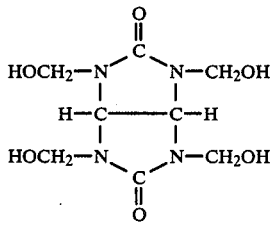

4 ACD

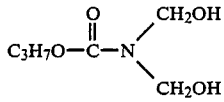

DMPC

The second major component of this finish is an alkyl ethoxylated quaternary. Because said additives have two alcoholic functional groups, they possess increased reactivity with the crosslinking agent. Second, the hydroxylated moieties further enhance the hydrophilic character of these binding agents and the long chain alkyl groups can contribute to fabric smoothness and softness in the finished fabric. Finally, the additive is bound to the fabric as shown by measured add-on subsequent to finishing. Once the fabric is crosslinked and has a grafted quaternay group, the fabric is dyed. To demonstrate the efficacy of the process, the efficiency of dye uptake is measured relative to cellulosic control.

Procedures based on the Kubelka-Munk equation are useed to measure dye absorption. This procedure utilizes a dilute dye solution to determine the wavelength of maximum dye absorption of a given dyestuff. Reflectance of the dye fabric is measured at the wavelength. In the Kubelka-Munk equation $$K/S = \frac{(1-R)^2}{2R}$$

K=light absorption coefficient
S=light scattering coefficient
R=reflectance or reflection factor K/S value is directly related to the color intensity of the fabric. Once reflectance, R, is determined, K/S can readily be calculated. The higher the K/S value, the greater the color depth and hence the greater the dye absorption in dyeing. For example, K/S value of mercerized cotton control is greater than that of untreated cotton control, reflecting the greater dyeability of cotton fabrics after mercerization.

K/S values are also used to approximate the amount of dye absorbed by a sample relative to that of cellulosic control, which is simultaneously dyed in the same dye bath. Thus, the K/S of a sample divided by the K/S of untreated cellulose control (either mercerized or unmercerized) times 100 equals the percent dye absorbed values.

The following dye procedures are set forth to demonstrate the preferred embodiments. Dye procedure A is used for dyeing with reactive dyes under alkaline conditions. In dye procedure A, 4 gms dye is used per 100 gms fabric. This is a standard method for dyeing with reactive dyes. Dye procedure B utilizes a mildly acidic dye bath in which 2 to 4 gms of dye per 100 gms fabric is used and a maximum bath temperature of 60° C. is maintained. In this procedure, anionic dyes such as a direct, reactive, soluble vats or acid dyes can be used.

Cellulosic fabric can be either prepared fabric (desized, scoured and bleached), mercerized or fabric which has been treated with liquid ammonia. Caustic mercerized fabric is preferable to achieve depth of shade in dyeing and improved lightfastness. A pad dry-cure treatment is applied to the selected cellulosic fabric. The finish comprises a crosslinking agent, catalyst, appropriate reactive additive and any selective auxiliaries such as wetting agents or softeners.

The fabric is dried and cured and it can be washed if desired. The fabric is then dyed with a cellulosic dye such as a reactive or direct dye. The preferred embodiment allows for flexibility not heretofore known for smooth dry cellulosic fabric because now cellulosic fabric can be dyed either at the textile mill, garment manufacturer or retailer.

The amount of crosslinking agent and additive employed in the finish can be varied over a wide range depending upon level of smooth-dry performance and percent dye absorption required relative to a non-crosslinked cellulosic control. In addition, with the quaternary reactive additive, fabrics with DP performance greater than untreated cellulose but less than true smooth-dry performance will show receptivity substantially greater than that of untreated cellulose. Under such conditions, this method offers a second utility namely the enhancement of the dye receptivity of cellulose fabrics.

Other applications arise in this process. Because the dye procedure employed with this additive is one utilized in dyeing wools, cellulose-wool fabrics treated with crosslinking agent and ethoxylated quaternary yield a DP cellulose-wool fabric that is dyeable with a reactive dye in a single dyeing. Example of blends in which this treatment would be effective are such as: cotton/wool; cotton/polyester; rayon/wool; rayon/-polyester; and other cellulosic-containing blends.

The fabric treated with crosslinking agent, acid catalyst and longchain alkyl bis hydroxyethyl amine salt in addition to having improved dyeability, also have increased add-on reflecting the binding of the longchain quaternary to the cellulose substrate. Because of this binding, the fabrics have improved hand and softness and frequently have improved durable press performance over control fabrics treated with a crosslinking formulation without a quaternary additive.

Another application is to print on cellulose fabric a formulation containing crosslinking agent, ethoxylated quaternary additive, thickener and acid catalyst. Once this mixture is dried and cured, the fabric is dyed using dye procedure B. Under these conditions, the printed areas are heavily dyed whereas the untreated areas are only lightly dyed, thus clearly delineating the print.

In another process variation, the fabric can be padded with a formulation containing crosslinking agent and acid catalyst, dried and then printed with a formulation containing the ethoxylated quaternary. The fabric is cured, washed and dyed with a cellulosic dye in a mildly acidic dye bath. Under such conditions the printed areas are deeply dyed and the non-printed areas are dye resist. Similar treatment of crosslinking agent and ethoxylated quaternary can be utilized for fiber and yarn treatments. If such treated yarns are mixed with yarns which are untreated or treated with crosslinking agents without additions in a fabric, an opportunity for crossdyeing arises when said fabrics are dyed with cellulosic dyes in a mildly acidic dye bath.

In addition to their influences on dyeability, these graft additives have a positive impact on the durable-press performance and strength properties. Durable-press improvements are particularly evident in the case of mercerized cotton fabrics.

The preferred embodiments of the invention are demonstrated but not limited to the following examples:

EXAMPLE 1

Mercerized Cotton Print Cloth Treated with Crosslinking Agent (GUR) and Ethoxylated Quaternaries and Dyed with Reactive Red 2 by Procedure B A pad bath (Bath A) was prepared containing 3% GUR, 2.5% magnesium chloride hexahydrate, 0.1% citric acid 0.1% nonionic wetting agent and the remainder water. A second bath (Bath B) was prepared containing 3% GUR (solids), 2.5% magnesium chloride hexahydrate, 0.1% citric acid, 0.1% wetting agent, 5% C-12 ethoxylated quaternary and the remainder water. A third pad bath (Bath C) was prepared the same as Bath B except that 5% C-25 ethoxylated quaternary was used. A fourth pad bath (Bath D) was prepared the same as bath B except that 5% 18–25 ethoxylated quat was used. A fifth pad bath (Bath E) was prepared the same as Bath B except that 5% 18–12 ethoxylated quaternay was used. Each of these pad baths was used to pad a different sample of a desized, scoured, bleached and mercerized cotton printcloth using 2-dips and 2-nips with 50 lb roll pressure on a 2-roll pad. Wet pickups of the different samples were about 80%. The fabrics were then dried for 7 minutes at 60° C. and cured for 4 minutes at 160° C. These samples together with a simple of untreated mercerized printcloth were then laundered. Durable press ratings for these samples are given in Table III. Furthermore, swatches of these fabrics were then dyed with Reactive Red 2 using dye procedure B. The dyed samples were then rinsed and laundered and the reflectance values of these samples were measured at the point of maximum absorption of the dyestuff. These reflectance values, derived K/S values, and calculated percent dye absorption relative to the untreated cotton control are also reported in Table III. These data clearly demonstrate the positive impact of the ethoxylated quaternary on durable press and on the post-dyeability characteristics of the crosslinked fabrics. The fabrics treated with the quaternary additives had improved softness and smooth-dry performance over the control fabric treated with a crosslinking formulation without any quaternary additive.

TABLE III

| Pad Bath | % GUR | % Quat | Quat | DP | % Reflectance | K/S | % Dye Absorbed[a] |
|---|---|---|---|---|---|---|---|
| A | 3 | 0 | — | 3.2 | 30.2 | 0.81 | 20 |
| B | 3 | 5 | C-12 | 3.5 | 4.6 | 9.89 | 244 |
| C | 3 | 5 | C-25 | 4.1 | 5.3 | 8.46 | 209 |
| D | 3 | 5 | 18–25 | 3.8 | 9.2 | 4.48 | 111 |
| E | 3 | 5 | 18–12 | 3.9 | 8.9 | 4.66 | 115 |
| Untreated Control | 0 | 0 | — | 1.0 | 29.7 | 0.83 | 20 |

[a]% dye absorbed is obtained by dividing K/S of a sample by the K/S of the untreated cotton and multiplying by 100; dye procedure B was used with the 4% dye on weight of the fabric; dyestuff is Reactive Red 2. The K/S (4.05) of untreated cottondyed with dye procedure A was taken as 100% and other fabrics calculated thereform.

EXAMPLE 2

Cotton Printcloth Treated with Crosslinking Agent (GUR) and Ethoxylated Quaternaries and Dyed with Reactive Red 2 by Procedure A Swatches of finished but undyed fabric from Example 1 plus an untreated control were dyed with Reactive Red 2 using dye Procedure A (dyeing under alkaline conditions). The dyed examples were rinsed and laundered and reflectance values of these samples were measured at the point of maximum absorption. The reflectance values, derived K/S values, and calculated percent absorption relative to untreated cotton are reported in Table IV. These data clearly demonstrate the positive impact of ethoxylated quaternary additives on the postdyeability characteristics of crosslinked fabrics.

TABLE IV

| Pad Bath | % GUR | % Quat | Quat | DP | % Reflectance | K/S | % Dye Absorbed[a] |
|---|---|---|---|---|---|---|---|
| A | 3 | 0 | — | 3.2 | 27.1 | 0.98 | 24 |
| B | 3 | 5 | C-12 | 3.5 | 6.4 | 6.84 | 169 |
| C | 3 | 5 | C-25 | 4.1 | 9.2 | 4.48 | 111 |
| D | 3 | 5 | 18–25 | 3.8 | 9.4 | 4.37 | 108 |
| E | 3 | 5 | 18–12 | 3.9 | 9.9 | 4.10 | 101 |
| Untreated Control | 0 | 0 | — | 1.0 | 10.0 | 4.05 | 100 |

[a]% dye absorbed is obtained by dividing K/S of a sample by the K/S of the untreated cotton and multiplying by 100; dye procedure A was used with 4% dye on the weight of the fabric; Dyestuff is Reactive Red 2.

EXAMPLE 3

Cotton Wool Blend (60/40) Treated with Crosslinking Agent (GUR) and Ethoxylated Quaternaries and Dyed with Reactive Red 2 by Procedure B Each of the pad-bath formulations described in Example 1 was used to pad a different sample of a 60% cotton-40% wool blend fabric using 2-dips and 2-nips with 50 lb roll on a 2-roll pad. Wet pickups of the different samples were about 65%. The fabrics were then dried for 7 minutes at 60° C. These samples together with a sample of untreated cotton-wool were then laundered. Durable press ratings for these samples are given in Table V. Furthermore, swatches of these fabrics were then dyed with Reactive Red 2 using dye procedure B. The dyed samples were then rinsed and laundered and the reflectance values of these samples were measured at the point of maximum absorption of the dyestuff. These reflectance values, derived K/S values, and calculated percent dye absorption relative to the untreated cotton-wool control are also reported in Table V. These data clearly demonstrate the positive impact of the ethoxylated quaternaries on post-dyeability characteristics of the crosslinked fabrics.

TABLE V

| Pad Bath | % GUR | % Quat | Quat | DP | % Reflectance | K/S | % Dye Absorbed[a] |
|---|---|---|---|---|---|---|---|
| A | 3 | 0 | — | 2.7 | 10.1 | 4.0 | 70 |
| B | 3 | 5 | C-12 | 2.9 | 3.1 | 15.1 | 265 |
| C | 3 | 5 | C-25 | 2.9 | 3.3 | 14.2 | 248 |
| D | 3 | 5 | 18–25 | 2.9 | 4.3 | 10.7 | 187 |
| E | 3 | 5 | 18–12 | 2.9 | 4.2 | 10.9 | 192 |
| Untreated Control | 0 | 0 | — | 2.2 | 7.4 | 5.7 | 100 |

[a]% dye absorbed is obtained by dividing K/S of a sample by the K/S of the untreated cotton-wool blend and multiplying by 100; dye procedure was used with 4% dye on weight of fabric; dyestuff is Reactive Red 2. Note: Control cotton-wool dyed under acidic conditions was taken as 100% in this instance.

EXAMPLE 4

Mercerized Cotton Print Cloth Treated with Crosslinking Agent (DMDHEU) and Ethoxylated Quaternary and Dyed with Reactive Red 2 by Procedure B A pad bath (Bath F) was prepared containing 3% DMDHEU (solids), 2.0% magnesium chloride hexahydrate, 0.1% citric acid, 0.1% nonionic wetting agent and the remainder water. A second pad bath (Bath G) was prepared containing 3% DMDHEU, 2.0% magnesium chloride hexahydrate, 0.1% citric acid, 0.1% wetting agent, 5% C-12 ethoxylated quaternary and the remainder water. Each of these pad baths was used to pad a different sample of a desized, scoured, bleached and mercerized cotton printcloth using the padding procedure described in Example 1. The padded samples were then dried, cured and laundered as in Example 1. Swatches of these fabrics plus an untreated control were dyed with Reactive Red 2 using dye procedure B. The dyed samples wer then rinsed and laundered and the reflectance values of these samples were measured at the point of maximum absorption of the dyestuff. These reflectance vlues, derived K/S values, and calculated percent dye absorption relative to the untreated cotton control are also reported in Table VI. These data clearly demonstrate the positive impact of the ethoxylated quaternary on post-dyeability characteristics of the crosslinked fabrics.

TABLE VI

| Pad Bath | Agent | % Agent | % Quat | Quat | DP | % Reflectance | K/S | % Dye Absorbed[a] |
|---|---|---|---|---|---|---|---|---|
| F | DMDHEU | 3 | 0 | — | 3.4 | 44.6 | 0.34 | 8 |
| G | DMDHEU | 3 | 5 | C-12 | 3.5 | 7.5 | 5.70 | 141 |
| H | DMPC | 4 | 0 | — | 3.1 | 35.0 | 0.60 | 15 |
| I | DMPC | 4 | 5 | C-12 | 3.1 | 4.6 | 9.89 | 244 |
| | Untreated Cotton Control | | | | 1.0 | 35.5 | 0.59 | 15 |

[a]% dye absorbed is obtained by dividing K/S of a sample by the K/S of the untreated cotton and multiplying by 100; dye procedure B was used with 4% dye on weight of dye bath; dyestuff is Reactive Red 2. The K/S (4.05) of untreated cotton dyed with dye procedure A was taken as 100% and the other fabrics were calculated therefrom.

EXAMPLE 5

Mercerized Cotton Printcloth Treated with Crosslinking Agent (DMPC) and Ethoxylated Quaternary and Dyed with Reactive Red 2 by Procedure B A pad bath (Bath H) was prepared containing 4% DMPC (solids), 2.0% magnesium chloride hexahydrate, 0.1% citric acid, 0.1% nonionic wetting wetting agent and the remainder water. A second pad bath was prepared containing 4% DMPC, 2.0% magnesium chloride hexahydate, 0.1% citric acid, 0.1% nonionic wetting agent, 5% C-12 ethoxylated quaternary and the remainder water (Bath I). Each of these pad baths was used to pad a different sample of a desized, scoured, bleached and mercerized cotton printcloth using the padding procedure described in Example 1. The padded samples were then dried, cured and laundered as in Example 1. Swatches of these fabrics plus an untreated control were dyed with Reactive Red 2 using dye procedure B.

The dyed samples were then rinsed and laundered and the reflectance values of these samples were measured at the point of maximum absorption of the dyestuff. These reflectance values, derived K/S values, and calculated percent dye absorption relative to the untreated cotton control are also reported in Table VI. These data clearly demonstrate the positive impact on the ethoxylated quaternary on the post-dyeability characteristics of the crosslinked fabrics.

EXAMPLE 6

Cotton-Wool Blend (60/40) Treated with Crosslinking Agent (DMDHEU) and Ethoxylated Quaternary and Dyed with Reactive Red 2 by Procedure B Each of the pad bath formulations described in Example 4 was used to pad a different sample of a 60% cotton-40% wool blend fabric using 2-dips and 2-nips with 50 lb roll pressure on a 2-roll pad. Wet pickups of the different samples were about 65%. The fabrics were then dried for 7 minutes at 60° C. These samples together with a sample of untreated cotton-wool were laundered. Durable press ratings are given in Table VII. Furthermore, swatches of these fabrics were then dyed ith Reactive Red 2 using dye procedure B. The dyed samples were then rinsed and laundered and the reflectance values of these samples were measured at the point of maximum absorption of the dyestuff. These reflectance values, derived K/S values, and calculated percent dye absorption relative to the untreated cotton control are also reported in Table VII. These data clearly demonstrate the positive impact of the ethoxylated quaternary on the post-dyeability characteristics of the crosslinked cotton-wool fabrics.

TABLE VII

| Pad Bath | Agent | % Agent | % Quat. | Quat. | DP | % Reflectance | K/S | % Dye Absorbed[a] |
|---|---|---|---|---|---|---|---|---|
| F | DMDHEU | 3 | 0 | — | 3.6 | 16.1 | 2.19 | 77 |
| G | DMDHEU | 3 | 5 | C-12 | 3.5 | 4.6 | 9.89 | 347 |
| H | DMPC | 4 | 0 | — | 3.3 | 15.3 | 2.34 | 82 |
| I | DMPC | 4 | 5 | C-12 | 3.3 | 4.5 | 10.13 | 355 |
| | Untreated Control | 0 | 0 | — | 2.2 | 13.2 | 2.85 | 100 |

[a]% dye absorbed is obtained by dividing K/S of a sample by the K/S of the untreated cotton-wool blend and multiplying by 100; dye procedure B was used with 4% dye on weight of fabric; dyestuff is Reactive Red 2. Untreated control dyed under acidic conditions was taken as 100% in this instance.

EXAMPLE 7

Cotton-Wool Blend (60/40) treated with Crosslinking Agent (DMPC) and Ethoxylated Quaternary and Dyed with Reactive Red 2 by Using Procedure B Each of the pad bath formulations described in Example 5 was used to pad a different sample of a 60% cotton-40% wool blend fabric using 2-dips and 2-nips with 50 lb roll pressure on a 2-roll pad. Wet pickups of the different samples were about 65%. The fabrics were then dried for 7 minutes at 60° C. These samples together with a sample of untreated printcloth were then laundered. Durable press ratings are given in Table VII. Furthermore, swatches of these fabrics were then dyed with Reactive Red 2 using dye procedure B. The dyed samples were then rinsed and laundered and the reflectance values of these samples were measured at the point of maximum absorption of the dyestuff. These reflectance values, derived K/S values, and calculated percent dye absorption relative to the untreated cotton control are also reported in Table VII. These data clearly demonstrate the positive impact of ethoxylated quaternary on the post-dyeability characteristics of the crosslinked fabrics.

EXAMPLE 8

Differential Dyeing with Reactive Red 2 of Knitted Fabrics Prepared From Treated and Untreated Yarns A pad bath was prepared containing 3 trimethylol acetylenediureine, 5% C-12 ethoxylated quaternary, 2% magnesium chloride hexahydrate, 0.1% citric acid, 0.1% nonionic wetting agent and the remainder water. A mercerized cotton yarn was padded with this formulation using a yarn treatment apparatus and the padded yarn was dried. Then, this yarn and untreated mercerized yarn were used to knit a jersey tube. Treated and untreated yarns were alternated every two inches in the fabric. The fabric was then pressed, and cured for 4 minutes at 160° C. and laundered. A one foot length of the fabric was then dyed with Reactive Red 2 using dye procedure B to produce a striped fabric.

Results showed the segments of fabric treated with crosslinking agent and C-12 ethoxylated quaternary dyed a deep red whereas the untreated cotton was lightly dyed. This experiment demonstrates the achievement of a crossdye effect in a single fabric using a yarn treatment with a combination of crosslinking agent and C-12 ethoxylated quaternary to form yarns with grafted quaternary sites. These sites were dyed with cotton dyes in a mildly acidic dye bath. Under the same conditions, untreated cotton yarns in the same fabric were only lightly dyed.

EXAMPLE 9

Differential Dyeing with Reactive Blue 29 of Knitted Fabrics Prepared from Treated and Untreated Yarns A one foot length of undyed cotton knit fabric as prepared in Example 8 was dyed with Reactive Blue 29 using dye procedure B. There was obtained a striped fabric in which the segments treated with crosslinking agent and ethoxylated quaternary were dyed a deep blue, whereas the untreated cotton was dyed a pale, light blue. This experiment demonstrated that the achievement of a crossdye effect in a single fabric using a yarn treatment with a combination of crosslinking agent and ethoxylated quaternary to produce yarns with grafted quaternary sites. These sites were dyes with a cotton dye in a mildly acidic dye bath. Under the same conditions, untreated cotton yarns in the same fabric are lightly dyed, thus leading to crossdyed fabric.

EXAMPLE 10

Differential Dyeing Using Reactive Yellow 27 on Knitted Fabrics Prepared from Separately Treated Yarns A pad bath was prepared containing 3% trimethylol acetylenediureine, 5% C-12 ethoxylated quaternary, 2% magnesium chloride hexahydrate, 0.1% citric acid, 0.1% nonionic wetting agent and the remainder water. A mercerized cotton yarn was padded with this formulation using a yarn treatment apparatus and the padded yarn was dried. A second pad bath was prepared containing 3% DMDHEU, 4% citric acid, 0.1% nonionic wetting agent and the remainder water. A second mercerized cotton yarn was padded with this second formulation using a yarn treatment apparatus and the padded yarn was dried. Then, these separate yarns were knitted into a jersey tube in which the two separately treated yarns were alternated in the knit after each two inch segment. The final knitted fabric was then pressed, cured for 4 minutes at 160° C. and laundered. A one foot length of this fabric was then dyed with Reactive Yellow using dye procedure A. There was produced a yellow and white striped fabric, the segments of the fabric made from yarn treated with crosslinking agent and citric acid were dye resist and therefore remainder undyed.

This experiment demonstrated a crossdyeable smooth-drying cotton fabric. The crossdyeing occurred because of the affinity of dye for crosslinked fabric segments with grafted quaternary groups and its non-affinity for crosslinked segments without grafted quaternary groups.

EXAMPLE 11

Differential Dyeing with Reactive Blue 29 of Knitted Fabrics Prepared from Separately Treated Yarns A one foot segment of cured and laundered undyed cotton knit fabric as prepared in Example 10 was dyed with Reactive Blue 29 using dye procedure B. A dark blue and pale blue striped fabric was produced. The segments of the fabric made from yarn untreated with crosslinking agent and ethoxylated quaternary were dyed a deep blue whereas the segments treated with crosslinking agent without quaternary graft were lightly tinted. This experiment demonstrated a crossdyeable smooth-drying cotton fabric. the crossdyeing occurred because of the affinity of dye for the crosslinked yarns with grafted quaternary groups and its non affinity for crosslinked segments without grafted quaternary groups.

EXAMPLE 12

Differential Dyeing with Reactive Red 2 of Knitted Fabrics Prepared from Separately treated Yarns A one foot segment of cured and laundered undyed cotton knit fabric as prepared in Example 10 was dyed with Reactive Red 2 using dye procedure B. A red and pink striped fabric was produced. The segments of the fabric made from yarn treated with crosslinking agent and ethoxylated quaternary were dyed a deep red whereas the segments treated with crosslinking agent without quaternary graft were tinted pink. This experiment demonstrated a crossdyeable smooth-drying cotton fabric. The crossdyeing occurred because of the affinity of dye for the crosslinked yarns with grafted quaternary groups and its non affinity for crosslinked segments without grafted quaternary groups.

EXAMPLE 13

Multicolored Dyeing of Knitted Fabrics Prepared From Treated and Untreated Yarns A pad bath was prepared containing 3% trimethylol acetylenediureine, 5% C-12 ethoxylated quaternary, 2% magnesium chloride hexahydrate, 0.1% citric acid, 0.1% nonionic wetting agent and the remainder water. A mercerized cotton yarn was padded with this formulation using a yarn treatment apparatus and the padded yarn was dried. Then, thus yarn and untreated mercerized yarn were used to knit a jersey tube. Treated and untreated yarns were alternated every two inches in the fabric. The fabric was then pressed, and cured for 4 minutes at 160° C. and laundered. A one foot length of the fabric was then dyed with Reactive Red 2 using dye procedure B (acidic conditions). The fabric was washed. The same fabric was then dyed with Reactive Yellow 27 using dye procedure A (alkaline conditions). The result was a bicolored striped fabric, which alternated two inch segments of orange-red and yellow.

EXAMPLE 14

Sequential and Selective Addition of Choline Quaternary to Sensitized Fabric and Subsequent Dyeing with Reactive Yellow 27

A pad bath was prepared comprising 5% trimethylol acetylenediureine, 2.1% magnesium chloride, 0.1% citric acid, 0.1% nonionic wetting agent and remainder water. A mercerized cotton twill fabric was padded with the above formulation. The fabric was then dried for 7 minutes at 60° C. Then, several print formulations were prepared comprising 5% ethoxylated quaternary and 0.5% hydroxyethylcellulose and the remainder water. The ethoxylated quaternary in these formulations were 0-12, 0-25, C-12, C-25 and 18/25. Then, each formulation was used to print with a eye dropper the name of its component quaternary (as a means of identification) on the twill fabric. The sample was then dried, cured and laundered as in Example 1. These fabrics was then dyed with Reactive Yellow 27 using dye procedure B.

The result was smooth-dry fabric with dyed yellow printed areas whereas non-printed areas remained undyed. Each area that had letters with a different grafted ethoxylated quaternary was dye receptive to the anionic dye whereas the other areas were dye resist. These results demonstrate that a differential dyeing effect can be achieved by sequential application of the crosslinking agent and reactive ethoxylated quaternary to the fabric. Further, it demonstrates the use of a crosslinking treatment without additive to dye resist certain areas of fabric while using an additive to achieve dyeing in the treated areas.

EXAMPLE 15

Cotton Twill Fabrics Treated with Crosslinking Agent (4-ACD) and Ethoxylated Quaternaries and Dyed with Reactive Red 111 by Procedure B A pad bath (Bath J) was prepared containing 5% 4-ACD, 6% C-25 ethoxylated quaternary, 2% $MgCl_2$, 0.1% citric acid, 0.1% nonionic wetting agent and the remainder water. A second bath (Bath K) was prepared the same as Bath J except that the ethoxylated quaternary used was 0-12. A third bath (Bath L) was prepared the same as Bath K except that the C-12 ethoxylated quaternary was used. Each of these pad baths was used to pad different samples of mercerized and unmercerized cotton twill using 2-dips and 2-nips with 50 lb roll pressure on a 2-roll pad. Wet pickups of the samples were about 65%. The fabrics were then dried for 7 minutes at 60° C. These samples together with a sample of untreated twill controls were then laundered. Swatches of these fabrics were then dyed with Acid Red 111 using dye procedure B. The dyed samples were then rinsed and laundered and the reflectance values of these samples were measured at the point of maximum absorption of the dyestuff. These reflectance values and derived K/S values were measured. The K/S values for the fabrics (mercerized and unmercerized) treated with C-25 ethoxylated were 6.8 and 7.2, for the fabrics treated with 0-12 ethoxylate were 6.3 and 5.5, and for the fabrics treated with C-12 ethoxylate were 5.6 and 7.1. By contrast, the value for the untreated mercerized control was 0.3. Since color is directly proportional to K/S value, it can be readily deduced that enhanced dyeability occurs because of the presence of the grafted quaternary groups.

EXAMPLE 16

Nonmercerized Cotton Printcloth Treated with Crosslinking Agent (4-ACD) and Ethoxylated Quaternary and Dyed with Direct Blue 1 by Dye Procedure B A pad bath (Bath M) was prepared containing 4% 4 ACD, 2.0% $MgCl_2$, 0.1% citric acid, 0.1% nonionic wetting agent and the remainder water. A second bath (Bath N) was prepared the same as Bath M except that 5% C-25 ethoxylated quaternary was added in addition to the other components. A third bath (Bath O) was prepared the same as Bath M except that 15% C-25 ethoxylated quaternary was added in addition to the other components. Each of these pad baths was used to pad different samples of mercerized cotton printcloths using 2-dips and 2-nips with 50 lb roll pressure on a 2-roll pad. Wet pickups of the different samples were about 80%. The fabrics were then dried for 7 minutes at 60° C. and cured for 4 minutes at 160° C. These samples together with a sample of untreated mercerized printcloth were then laundered. Durable press ratings and add-ons for these samples are given in Table VIII. The positive impact of the quaternary on the add-on and hence grafted quaternary can be readily noted. Furthermore, swatches of these fabrics were then dyed with Direct Blue 1 using dye procedure B. The dyed samples were then rinsed and laundered and the reflectance values of these samples were measured at the point of maximum absorption of the dyestuff. These reflectance values, derived K/S values, and calculated percent dye absorption relative to untreated cotton control are also reported in Table VIII. These data clearly demonstrate the positive effect of increasing quantities of grafted ethoxylated quaternary on the post-dyeability characteristics of the crosslinked fabrics.

In addition, the fabrics finished with crosslinking agent and ethoxylated quaternary had improved softness and hand. The increased add-on after laundering reflects the chemical binding of the quaternary to the cellulose substrate.

TABLE VIII

| Cotton Twill Fabric | Pad Bath | % 4ACD | % C-25 Quat | % Add-On | DP | % Reflectance | K/S | % Dye Absorbed[a] |
|---|---|---|---|---|---|---|---|---|
| Unmercerized | M | 4 | 0 | 0.0 | 4.5 | 66.6 | 0.1 | 2 |
| " | N | 4 | 5 | 3.0 | 4.6 | 6.1 | 7.2 | 126 |
| " | O | 4 | 15 | 7.8 | 4.2 | 2.9 | 16.3 | 286 |
| Mercerized | M | 4 | 0 | 0.8 | 3.1 | 65.2 | 0.1 | 2 |
| " | N | 4 | 5 | 3.8 | 3.2 | 8.5 | 4.9 | 86 |
| " | O | 4 | 15 | 9.0 | 3.3 | 3.3 | 14.2 | 249 |
| Untreated Mercerized Control | — | — | — | 0 | 1.0 | 16.8 | 2.1 | 37 |

[a]% dyed absorbed is obtained by dividing K/S of a sample by th K/S of the untreated cotton and multiplying by 100; dye procedure B was used with 4% dye on weight of sample; dyestuff is Direct Blue 1. The K/S (5.7) of untreated mercerized cottondyed with a conventional direct dye procedure was taken as 100% and other fabrics calculated therefrom.

EXAMPLE 17

Mercerized Cotton Printcloth Treated with Crosslinking Agent and Ethoxylated Quaternary and Dyed with Reactive Red 2 Using Dye Procedure B Undyed swatches of samples prepared in Example 16 were dyed with Reactive Red 2 using dye procedure B. The dyed samples were then rinsed and laundered. Inspection of the samples after laundering revealed that the untreated cotton (4 ACD and no quaternary in the finish) were only slightly tinted, whereas the fabric with 4% 4ACD and 5% ethoxylated quaternary were red and the samples with 4% 4ACD and 15% ethoxylated quaternary were a much deeper red.

EXAMPLE 18

Unmercerized Cotton Printcloth Treated Crosslinking Agent (GUR) and Ethoxylated Quaternary and Dyed with Direct Blue 1 by Procedure B Samples of unmercerized cotton printcloth were padded with Bath A (from Example 1) and a second sample was padded with Bath B. The padding, drying, curing and laundering procedures were the same as employed in Example 1. Swatches of these fabrics were then dyed with Direct Blue 1 using dye procedure B. The dyed samples were then rinsed and laundered and the reflectance values of these samples were measured and K/S values of the fabrics were calculated. The sample treated with crosslinking agent only (Bath A) had a K/S of 0.2 whereas the fabric treated with crosslinking agent and ethoxylated quaternary C-12 had a K/S value of 5.4. Since increasing K/S values measure increasing color intensity, it is seen that the crosslinked fabric with the grafted quaternary dyed whereas the crosslinked fabric without the grafted quaternary was dye resist. Visual inspection of the fabrics likewise led to the same conclusion in that the sample treated with the C-12 quaternary was dark blue and the crosslinked control was barely tinted.

EXAMPLE 19

Durable Fixing of Ethoxylated Quaternary on Cotton Fabric

A pad bath (Bath P) was prepared containing 8% DMDHEU, 2.5% $MgCl_2$ 0.1% wetting agent and the remainder water. A second bath (Bath Q) was prepared by same as Bath P except that 15% C-25 ethoxylated quaternary was added in addition to the other components. Each of these pad baths was used to pad different samples of unmercerized and mercerized cotton printcloths using 2-dips and 2-nips with 50 lb roll pressure on a 2-roll pad. Wet pickups of the different samples were about 80%. The fabrics wer then dried for 7 minutes at 60° C. and cured for 4 minutes at 160° C. These samples were then laundered. With the unmercerized fabric, the fabric treated with crosslinking agent without any ethoxylated quaternary had an add-on of 4.6% whereas the fabric with the C-25 ethoxylated quaternary had an add-on of 12.2%. The similarly finished mercerized fabrics had add-ons of 3.0% without the quaternary and 11.7% with the quaternary. These results graphically show the binding action of the crosslinking agent in durably fixing the ethoxylated quaternary softener on the fabric.

I claim:

1. A process for producing a dyed, durably soft, smooth-dry cellulose fabric comprising:

(a) padding a cellulose-containing fabric with a sufficient amount of an aqueous finishing solution comprising sufficient concentrations of N-methylol crosslinking agent, acid catalyst and alkyl bishydroxyethyl quaternary to impart smooth-dry performance, dye receptivity and durable softness properties to the fabric;

(b) drying and during the padded fabric for sufficient time at sufficient temperature to interact components of the finish with the cellulosic-containing fabric and thereby produce a smooth-dry cellulosic fabric with durable softening and dyeability properties; and, (c) dyeing the fabric of step (b) with a cellulosic or anionic dye in a mildly acidic dyebath.

2. The process of claim 1 wherein the cellulose-containing fabric is selected from the group consisting of: cotton, cotton-wool blend, cotton-rayon blend, rayon, rayon-wool blend, and cotton-synthetic blends.

3. The process of claim 1 wherein the N-methylol crosslinking agent is selected from the group consisting of: dimethylol dihydroxyethyleneurea, trimethylol acetylenediureine, tetramethylol acetylenediureine, methylol melamine, methylol dicarbamate and dimethylol propylcarbamate.

4. The process of claim 1 wherein the N-methylol crosslinking agent is selected from the group consisting of: zinc nitrate hexahydrate, magnesium chloride hexahydrate, and mixed catalyst of magnesium chloride hexahydrate and citric acid.

5. The process of claim 1 wherein the aqueous finishing solution includes a nonionic wetting agent of sufficient concentration to achieve efficient wetting of the cellulosic fabric.

6. The process of claim 1 wherein the padding solution contains from about 1 to 12% N-methylol crosslinking agent, 0.15 to 4% acid catalyst and 0.5 to 15% alkyl bishydroxyethyl quaternary.

7. The process of claim 1 wherein the alkyl group is a longchain alkyl group of the quaternary which contains from about 6 to 30 carbon atoms.

8. The process of claim 1 wherein the bishydroxyethyl component contains from about 2 to b 50 ethyleneoxide units.

9. The process of claim 7 wherein the longchain alkyl group can be a mixed alkyl in which the dominant group can be selected from the group consisting of dodecyl, tetradecyl, hexadecyl, octadecyl, octadecenyl and octadecadienyl.

10. A process for selectively dyeing a print on a cellulose-containing fabric comprising padding the cellulose containing fabric with an aqueous finishing solution comprising sufficient concentrations of N-methylol crosslinking agent and acid catalyst to impart smooth-dry performance to the fabric; drying the fabric for sufficient time at sufficient temperature to remove moisture; printing on the fabric with an aqueous solution of sufficient concentration of alkyl bishydroxyethyl quaternary to impart dye receptivity properties to the printed areas of the fabric; curing the fabric for sufficient time at sufficient temperature to interact the padded and printed solutions with the fabric and then dyeing the fabric with a cellulosic or other anionic dye.

11. The process of claim 10 wherein the fabric is dyed with a cellulosic or other anionic dye in a mildly acidic dyebath.

12. The process of claim 10 wherein the aqueous printing solution comprises an alkyl bishydroxyethyl quaternary and a thickening agent.

13. The process of claim 12 wherein the alkyl group is a longchain alkyl group of the quaternary which contains from about 6 to 30 carbon atoms.

14. The process of claim 12 wherein the bishydroxyethyl component contains from about 2 to 50 ethyleneoxide units.

15. The process of claim 13 wherein the long chain alkyl group can be a mixed alkyl in which the dominant group can be selected from the group consisting of dodecyl, tetradecyl, hexadecyl, octadecyl, octadecenyl and octadecadienyl.

16. The process for producing a differentially dyed, durably soft, smooth-dry cellulosic fabric comprising:

(a) immersing a cellulosic yarn into a sufficient amount of an aqueous finishing solution comprising sufficient concentrations of N-methylol crosslinking agent, acid catalyst and alkyl bishydroxyethyl quaternary to impart smooth-dry performance and dye receptivity to the yarn;

(b) drying the cellulosic yarn of (a) for sufficient time at sufficient temperature to remove moisture;

(c) immersing another cellulosic yarn into a sufficient amount of an aqueous finishing solution comprising sufficient concentrations of: N-methylol crosslinking agent and acid catalyst to impart smooth-dry and dye-resist properties to the yarn;

(d) drying the treated yarn of (c) for sufficient time at sufficient temperature to remove moisture;

(e) combining yarn (b) with yarn (d) so as to produce a fabric with preselected dye resist and dye receptive areas;

(f) curing the fabric at sufficient temperature for sufficient time to interact the finishing components with the fabric; and then;

(g) dyeing the fabric with a cellulosic or other anionic dye thereby producing a differentially dyed, smooth-dry fabric with durable softening properties.

17. The process of claim 16 wherein the fabric is dyed with a cellulosic or other anionic dye in a mildly acidic dyebath.

18. The process of claim 16 wherein the alkyl group of the quaternary is a long chain alkyl group which contains from about 6 to 30 carbon atoms.

19. The process of claim 16 wherein the bishydroxyethyl component contains from about 2 to 5 ethyleneoxide units.

20. The process of claim 18 wherein the longchain alkyl group can be a mixed alkyl in which the dominant group can be selected from the group consisting of dodecyl, tetradecyl, hexadecyl, octadecyl, octadecenyl and octadecadienyl.

21. A process for producing a differentially dyed, durably soft, partially smooth-dry cellulosic fabric comprising:

(a) immersing a cellulosic yarn into a sufficient amount of an aqueous finishing solution comprising sufficient concentrations of N-methylol crosslinking agent, acid catalyst and alkyl bishydroxyethyl quaternary to impart smooth-dry performance and dye receptivity to the yarn;

(b) drying the cellulosic yarn of (a) for sufficient time at sufficient temperature to remove moisture;

(c) combining the yarn of step (b) with an untreated yarn so as to produce a fabric with preselected dye resist and dye receptive areas when subjected to dyeing under acidic conditions;

(d) curing the fabric at sufficient temperature for sufficient time to interact the finishing components with the fabric; and then, (e) dyeing the fabric with a cellulosic or other anionic dye in a mildly acidic dyebath thereby producing a differentially dyed, durably soft, partially smooth-dry fabric.

22. The process of claim 21 wherein the alkyl group of the quaternary is a long chain alkyl group which contains from about 6 to 30 carbons.

23. The process of claim 21 wherein the bishydroxyethyl component contains from about 2 to 50 ethhyeneoxide units.

24. The process of claim 22 wherein the longchain alkyl group can be a mixed alkyl in which the dominant group can be selected from the group consisting of dodecyl, tetradecyl, hexadecyl, octadecyl, octadecenyl and octadecadienyl.

25. A process for producing a crossdyed, durably soft, partially smooth-dry cellulosic fabric comprising:

(a) immersing a cellulosic yarn into a sufficient amount of an aqueous finishing solution comprising sufficient concentrations of N-Methylol crosslinking agent, acid catalyst and alkyl bishydroxyethyl quaternary to impart smooth-dry performance and dye receptivity to the yarn;

(b) drying the cellulosic yarn of (a) for sufficient time at sufficient temperature to remove moisture;

(c) combining the yarn of step (b) with an untreated yarn so as to produce a fabric with preselected dye resist and dye receptive areas when subjected to dyeing under acidic conditions;

(d) curing the fabric at sufficient temperature for sufficient time to interact the finishing components with the fabric;

(e) dyeing the fabric with a cellulosic or other anionic dye in a mildly acidic dyebath;

(f) washing the fabric to remove unreacted dyestuff and then immersing the fabric in an alkaline dyebath containing reactive dyestuff of different color than that of step (e) for sufficient time to dye the fabric and thereby produce a bicolored, durably soft, partially smooth-dry cellulosic fabric.

26. The process of claim 25 wherein the alkyl group of the quaternary is a longchain alkyl group which contains from about 6 to 30 carbon atoms.

27. The process of claim 25 wherein the bishydroxyethyl component contakins from about 2 to 50 ethyleneoxide units.

28. The process of claim 26 wherein the longchain alkyl group can be mixed alkyl in which the dominant group can be selected from the group consisting of dodecyl, tetradecyl, hexadecyl, octadecyl, octadecenyl and octadecadienyl.

* * * * *